United States Patent [19]

Tanabe et al.

[11] Patent Number: 4,935,054

[45] Date of Patent: Jun. 19, 1990

[54] METHOD OF CHARGING CHROMIUM ORES IN A SMELTING REDUCTION

[75] Inventors: Haruyoshi Tanabe; Masahiro Kawakami; Kenji Takahashi; Katsuhiro Iwasaki; Shigeru Inoue; Hitoshi Kawata, all of Tokyo, Japan

[73] Assignee: NKK Corporation, Tokyo, Japan

[21] Appl. No.: 295,207

[22] PCT Filed: Sep. 9, 1988

[86] PCT No.: PCT/JP88/00911

§ 371 Date: Jan. 3, 1989

§ 102(e) Date: Jan. 3, 1989

[87] PCT Pub. No.: WO89/02477

PCT Pub. Date: Mar. 23, 1989

[30] Foreign Application Priority Data

Sep. 10, 1987 [JP] Japan ..... 62-225253
Jan. 29, 1988 [JP] Japan ..... 63-20472

[51] Int. Cl.[5] ..... C21B 11/00; C22B 34/32
[52] U.S. Cl. ..... 75/501; 75/623
[58] Field of Search ..... 75/40, 84, 21, 26, 51.1, 75/51.2, 51.5; 266/182

[56] References Cited

U.S. PATENT DOCUMENTS

| | | | |
|---|---|---|---|
| 1,715,155 | 5/1929 | Westberg | 75/51.5 |
| 3,169,055 | 2/1965 | Josefsson et al. | 75/40 |
| 4,430,117 | 2/1984 | Spenceley et al. | 75/51.5 |

FOREIGN PATENT DOCUMENTS

| | | | |
|---|---|---|---|
| 222397 | 5/1987 | European Pat. Off. | 75/84 |
| 158320 | 12/1979 | Japan . | |
| 140313 | 8/1984 | Japan | 266/182 |
| 208409 | 10/1985 | Japan | 75/40 |
| 34111 | 2/1986 | Japan | 75/51.1 |

*Primary Examiner*—Melvyn J. Andrews
*Attorney, Agent, or Firm*—Moonray Kojima

[57] ABSTRACT

This invention relates to a method of checking flying losses of ores and coal when they are charged for carrying out smelting reduction of Cr ores and iron ores. In the invention, the raw materials are charged into the furnace through a chute extending nearly a mouth of the furnace or connected to a furnace body. Further, while gas is jetted toward an outside of the chute from a nozzle provided in an circumferential direction of an inside nearly the end of the chute, thereby to enable to exactly check the flying losses of the raw materials.

7 Claims, 4 Drawing Sheets

METHOD OF CHARGING CHROMIUM ORES IN A SMELTING REDUCTION

TECHNICAL FIELD

The present invention relates to a method of charging powder ore raw materials, iron ores and coal in a smelting reduction thereof.

BACKGROUND OF THE INVENTION

High Cr steel as stainless steel has been conventionally produced from ferrochromium as raw material. In view of saving energy and securing low production cost, a so-called smelting reduction method has been recently remarked, which directly obtains high Cr molten metal from Cr ores. In this method, Cr ores, coal and so on are charged into a reduction furnace of a converter type for reducing Cr so as to directly produce high Cr molten metal therefrom.

Cr raw ores are very fine in grain diameters, and ordinarily around 90% contain those having grain diameters of not more than 1 mm. Therefore, when powder Cr raw ores are charged into the reduction furnace from its top part onto the bath, they are lost up to 30% by upflowing gas.

For avoiding flying losses, an injection charging may be suggested, but special facilities are required independently therefor, and transporting pipes are easily injured by hard Cr ores. Thus, such measures could not be adopted actually.

In view of these circumstances, Cr raw ores are formed into pellets or briquets, inviting high production costs. If the ores are agglomerated, specific surface areas of the ores are made small so that a pre-heating time is made long and the reduction rate is lowered to lengthen the treatment time.

On the other hand, as an iron making method in place of the furnace production, the smelting reduction method of iron ores has been remarked as stated above in view of saving the energy and securing the low production cost.

In this smelting reduction method of iron ores, the flying loss of ores is not a big problem because the ores are coarse, but the coal as combustion fuel is scattered and lost considerably. According to the inventors'studies, why yield of the coal is inferior in the top charge method, is because the coal is broken by rapid increasing of temperature. Since the coal has volatility and the interior of the smelting furnace is at very high temperature (more than 1400° C.), the coal charged by top charge method abruptly becomes high temperature and cracked, and parts of fine powders generated by the heat cracking are exhausted out of the furnace together with the exhausted gas. The flying of the coal makes unit consumption of carbonaceous materials deteriorate in the smelting reduction of the iron ores.

The present invention is to provide a method of charging ores, carbonaceous material as checking their flying losses in the smelting reduction method of Cr ores, iron ores and so on.

SUMMARY OF THE INVENTION

For accomplishing this object, in the invention, powder Cr raw ores, or iron ores and coal are charged into the furnace through a charging chute extending near a furnace mouth of the smelting furnace of the converter type or connected to the furnace body thereof, so that the flying losses of the ores and coal are checked.

In addition, the powder Cr raw ores, the iron ores and the coal are charged into the furnace while the gas is jetted toward the outside of the charging chute, thereby to enable to charge the raw materials as checking effectively the flying losses.

BRIEF DESCRIPTION OF THE DRAWINGS

FIG. 2 explains another embodiment of the invention; FIG. 3 explains a gas jetting from an end of the charging chute; FIG. 4 investigates the flying losses of grain Cr raw ores of the invention method and the comparative method; FIG. 5 investigates Cr increasing rate in the molten metal when powder Cr raw ores are charged and pelletized Cr raw ores are charged;

FIG. 6 explains a further embodiment of the invention; FIG. 7 explains a still further embodiment of the invention; and FIG. 8 investigates the flying losses of grain Cr raw ores of the invention method and the comparative method.

Figure 1:
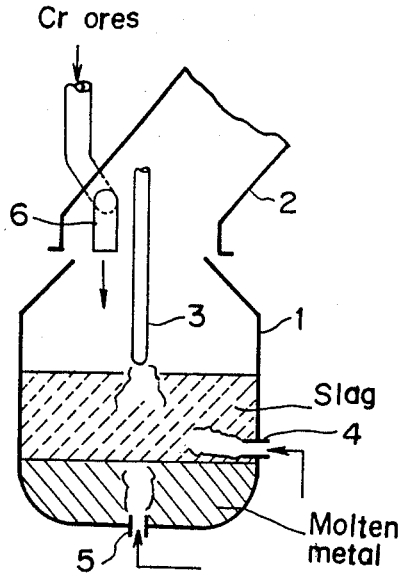
FIGS. 1 to 5 concern the smelting reduction of Cr ores, and FIG. 1 explains one embodiment of the invention.

In the drawings, 1 is a furnace body, 6, 6' chutes.

DETAILED DESCRIPTION OF THE INVENTION

The invention will be explained in detail.

FIG. 1 shows one embodiment of the invention in the smelting reduction of Cr ore, where the reference numeral 1 is the furnace body, and 2 is an exhausting hood provided at a top part of the furnace body. As the smelting reduction method by the converter type, there have been various proposals or studies which are different in the gas blowing practices. For example, as shown in FIG. 1, the gases are blown from a top blowing lance 3, a side blowing tuyere 4 and a bottom blowing tuyere 5 for carrying out the smelting reduction.

During the treatment, Cr ores are supplied together with carbonaceous materials, and in the invention, the powder Cr raw ores are supplied by the chute 6 extending through the exhaust hood 2 to nearly the furnace mouth.

The charging chute 6 is determined at a height of its lower end so that it does not contact the furnace body when the furnace is tilted.

Figure 2:
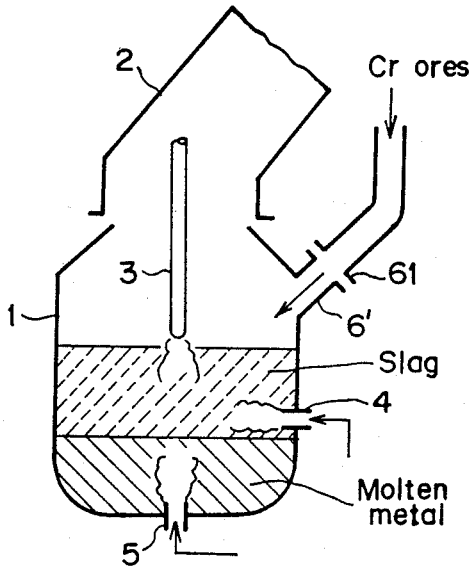

FIG. 2 shows that the powder Cr and raw ores are charged via a chute 6' connected to the upper part of the furnace body 1, and also in this case the same effect could be obtained.

The charging chute 6' may be separated at a part 61 on the way, and when the furnace body is tilted, this part 61 is separated.

Figure 3:
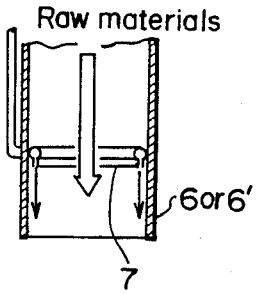

For charging Cr ores through the chute 6 or 6', while the gas (air or $N_2$) is jetted toward the outside of the chute from the nozzle 7 provided in a circumferential direction of the inner part around the chute as shown in FIG. 3, the powder Cr raw ores may be charged into the furnace, thereby to enable to exactly avoid the flying losses of the raw materials.

If the gas is jetted from the nozzle provided in the circumferential direction within the chute toward the outside of the chute, the powder Cr ores are guided in the gas jetting direction and the ore flying is exactly avoided. Besides, the jet gas also serves as a purge gas for preventing invasion of CO and $CO_2$ of the furnace into the chute.

Figure 6:
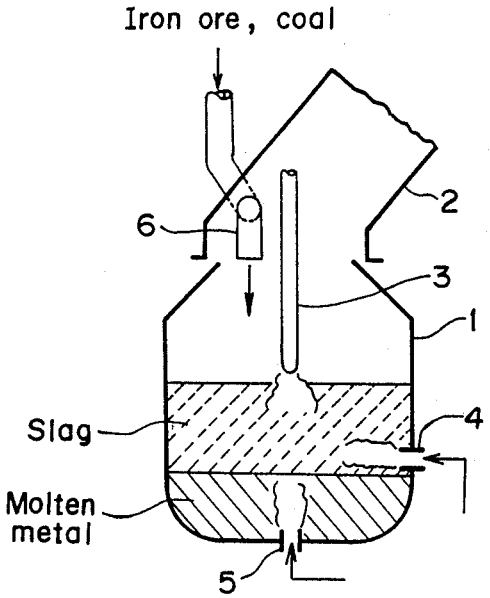
FIGS. 6 to 8 concern the smelting reduction of iron ores.

FIG. 6 shows a further embodiment of the invention in the smelting reduction of the iron ores, where the iron ores and the coal are charged into the furnace from the chute 6. Other structures are the same as illustrated in FIG. 1.

Figure 7:
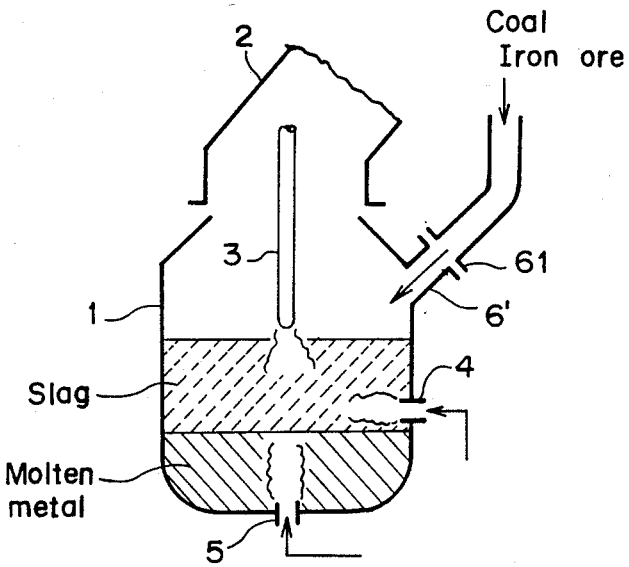

FIG. 7 shows that the iron ores and the coal are charged via the chute 6' connected to the top part of the furnace body 1, and the structure is the same as illustrated in FIG. 2.

In the above mentioned chargings of the iron ores and the coal by the chute 6 or 6', while the gas (the air or $N_2$) is jetted toward the outside of the chute from the nozzle 7 provided in a circumferential direction of the inner part in vicinity of the chute as shown in FIG. 3, the iron ores and the coal may be charged into the furnace, thereby to enable to exactly check the flying losses of the raw materials.

EXAMPLE 1

The smelting reduction was carried out as charging the powder Cr raw ores into the smelting reduction furnace (capacity: 5 ton) of the converter type by the method as shown in FIG. 1. The dispersion in grain diameters of the charged Cr raw ores are as follows.

| +1 mm | +0.5 mm | +0.25 mm | +0.149 mm | −0.149 mm |
|---|---|---|---|---|
| 1.7% | 3.8% | 20.1% | 42.9% | 31.5% |

Figure 4:
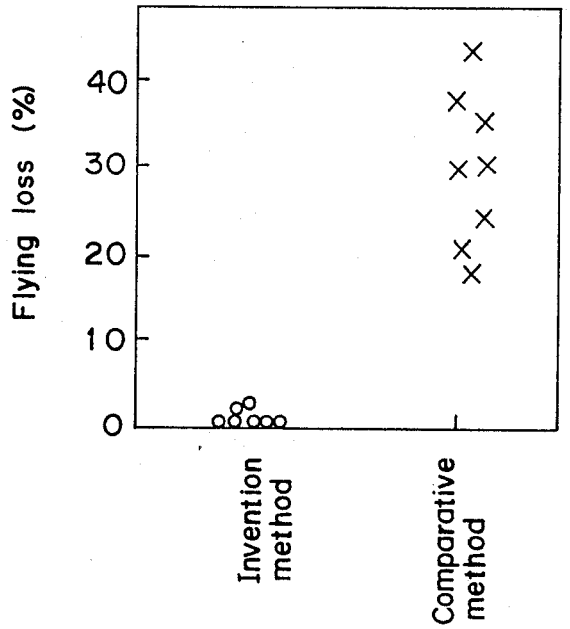

FIG. 4 shows the flying losses of Cr raw ores at the above charging in comparison with the case (comparative method) not using the charging chute, from which it is seen that the flying losses of Cr raw ores were considerably decreased by the present invention method.

Figure 5:
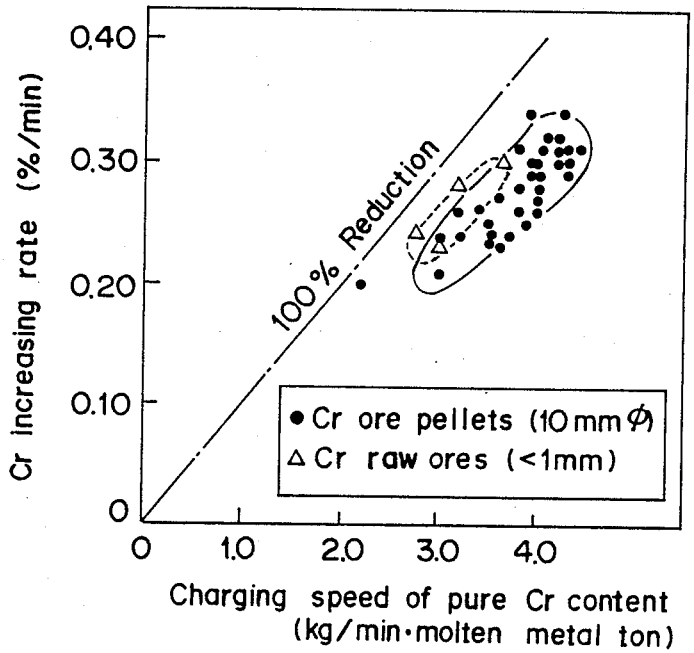

FIG. 5 investigates Cr reducing rate (Cr increasing rate in the molten metal) when grain Cr raw ores were charged as they were, and the pelletized Cr raw ores were charged, from which it is seen that the former is shorter to pre-heat the ores, and is faster to reduce Cr than the latter.

EXAMPLE 2

The smelting reduction was carried out as charging the Cr iron ores and the coal into the smelting reduction furnace (capacity: 5 ton) of the converter type by the method as shown in FIG. 6. The comparative method did not use the charging chute as shown in FIG. 6, and practiced the smelting reduction while charging the raw materials. The producing conditions are as follows.

TABLE 1

| | Comparative Method | Invention Method |
|---|---|---|
| $O_2$ for decarburization ($Nm^3/Hr$) | 1300 | 1300 |
| $O_2$ for post combustion ($Nm^3/Hr$) | 1300 | 1300 |
| Gas flow rate (m/sec) | 7.7 | 7.7 |
| Unit consumption of carbonaceous material (including the flying loss) (kg/molten metal ton) | 950 | 665 |
| Unit consumption of the flying loss of carbonaceous material (kg/molten metal) | 285 | 0 |

Figure 8:
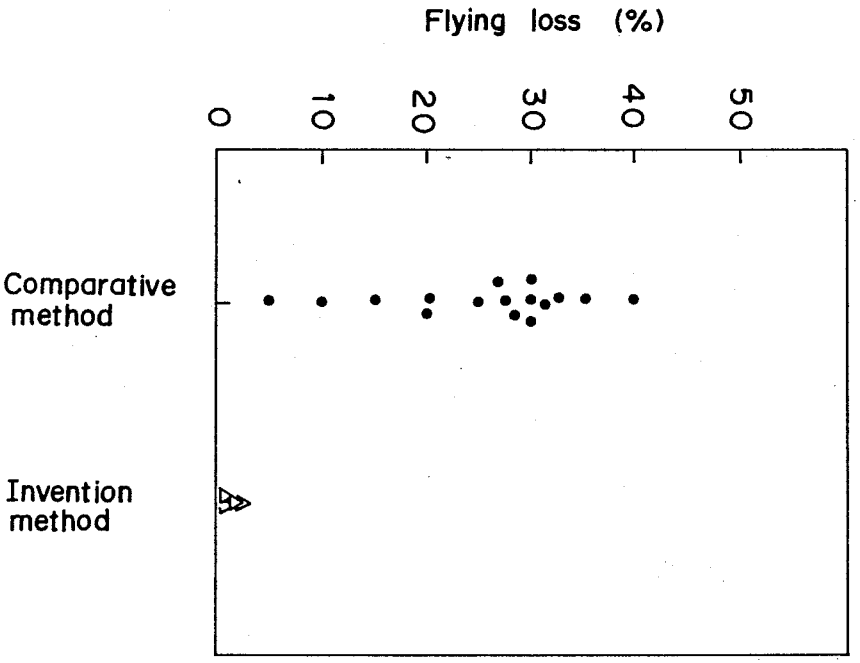

FIG. 8 shows the flying losses of the coal in comparison with the case not using the chute (the comparative method), from which it is seen that the flying losses of the coal was decreased considerably by the present invention method.

INDUSTRIAL APPLICATION

The present invention is useful to charging of raw materials or the coal as the carbonaceous materials in the smelting reduction of the Cr ores or the iron ores.

What is claimed is:

1. A method of charging raw materials in a smelting reduction of ores using a smelting reduction coverter furnace comprising a vessel for holding molten metal and slag, means for supplying a first gas into said slag, a mouth, and a hollow chute located at the mouth of said furnace for supplying raw ore therethrough into said vessel; said method comprising the steps of charging raw ore into said vessel of said furnace through said hollow chute; and concurrently with the charging of raw ore supplying a second gas inside said hollow chute and substantially about the inner circumferential periphery thereof and in the same direction of travel as the charging raw ore, so as to substantially surround the raw ore while traveling through the hollow chute and while traveling into said vessel of said furnace, thereby to prevent flying of said charging raw ore.

2. The method of claim 1, wherein the charging raw ore is chromium ore.

3. The method of claim 1, wherein the charging raw ore is iron ore and coal.

4. The method of claim 1, wherein the second gas is supplied at least at the end of the hollow chute closest to the furnace mouth.

5. The method of claim 1, wherein the second gas is air.

6. The method of claim 1, wherein the second gas is nitrogen.

7. The method of claim 1, wherein the hollow chute comprises a first part fitted to the furnace, and a second part movably attached to the first part.

* * * * *